US005080300A

United States Patent [19]

Stubbs et al.

[11] Patent Number: 5,080,300

[45] Date of Patent: Jan. 14, 1992

[54] LAUNCHER CONTROL SYSTEM FOR SURFACE LAUNCHED ACTIVE RADAR MISSILES

[75] Inventors: David W. Stubbs, Tuscon, Ariz.; William P. Laney, Camarillo, Calif.; Robert Rosen, Granada Hills, Calif.; Brock G. McCaman, Chatsworth, Calif.

[73] Assignee: Hughes Aircraft Company, Los Angeles, Calif.

[21] Appl. No.: 447,320

[22] Filed: Dec. 7, 1989

[51] Int. Cl.[5] ..... F41G 7/00

[52] U.S. Cl. ..... 244/3.11; 244/3.14

[58] Field of Search ..... 244/3.11, 3.14

[56] References Cited

U.S. PATENT DOCUMENTS 3,962,537 6/1976 Kerns et al. ..... 178/6.8
4,093,153 6/1978 Bardash et al. ..... 244/3.14
4,705,237 11/1987 Goldfield et al. ..... 244/3.12

*Primary Examiner*—Brian S. Steinberger

*Attorney, Agent, or Firm*—C. D. Brown; R. M. Heald; W. K. Denson-Low

[57] ABSTRACT

In a weapon system 10 incorporating a target position sensor (14), an information system (16), a power source (24), a launcher (20), and an airborne vehicle (18), a launcher control system (12) incorporates a communications interface (26) for coupling the information system (16) and the target position sensor (14) to a launcher (20) and an airborne vehicle (18). The communications interface (26) receives target position information and launch and control orders and provides launcher and airborne vehicle status. A airborne vehicle interface (28) couples the launcher (20) and the airborne vehicle (18) to the information system (16) and a power source (22). A transmitter (30) communicates updated target position information to the airborne vehicle after launch. A power control means (32) converts and regulates power from different power sources (22) to be used by the launcher control system (12). The launcher (20) with launcher control system (12) is preferably modular in construction and is separate from the information system (16) and target position sensor (14).

13 Claims, 2 Drawing Sheets

LAUNCHER CONTROL SYSTEM FOR SURFACE LAUNCHED ACTIVE RADAR MISSILES

BACKGROUND OF THE INVENTION

1. Technical Field

The present invention relates to missile launchers and, more specifically, to a launcher control system for controlling the launch and flight of an airborne vehicle.

2. Discussion

The purpose of a launching system is to place a weapon into a flight path as rapidly as required. Launching systems must perform with speed and reliability while displaying weapon system compatibility. However, system flexibility and performance is often limited by the design limitation of the launcher system to a specific environment, such as ground-to-air, ship-to-air, etc.

SUMMARY OF THE INVENTION

It is an object of the present invention to provide a standard launcher control system that can be employed in a multitude of environments, thereby expanding the useful environment of the weapon being deployed. In the preferred embodiment, the system is designed to control the launch and flight of what was originally designed exclusively to be an air-to-air missile, the Advanced Medium Range Radar Air-to-Air Missile (AMRAAM), although other embodiments envision this same concept being applied to any type of active radar guided airborne vehicle.

In accordance with the teachings of the present invention, a system for controlling the launch and flight of an airborne vehicle, is provided. The launcher control system is modular in construction, employing standard equipment, and is easily deployable in a variety of environments. It employs a communications interface for receiving target position information and launch control orders, and for providing launcher and airborne vehicle status information to an information system. An airborne vehicle interface couples the launcher control system to the launcher and airborne vehicle. The airborne vehicle interface provides power to the airborne vehicle for launch and data and control signals to test and launch the airborne vehicle, and determines the status of the airborne vehicle. A transmitter for communicating updated target information to the airborne vehicle is also provided. Finally, the system employs a power converter for converting various forms of input power to power forms required by the launcher control system components. Regulation of system input power and overload protection for all system components is also provided.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
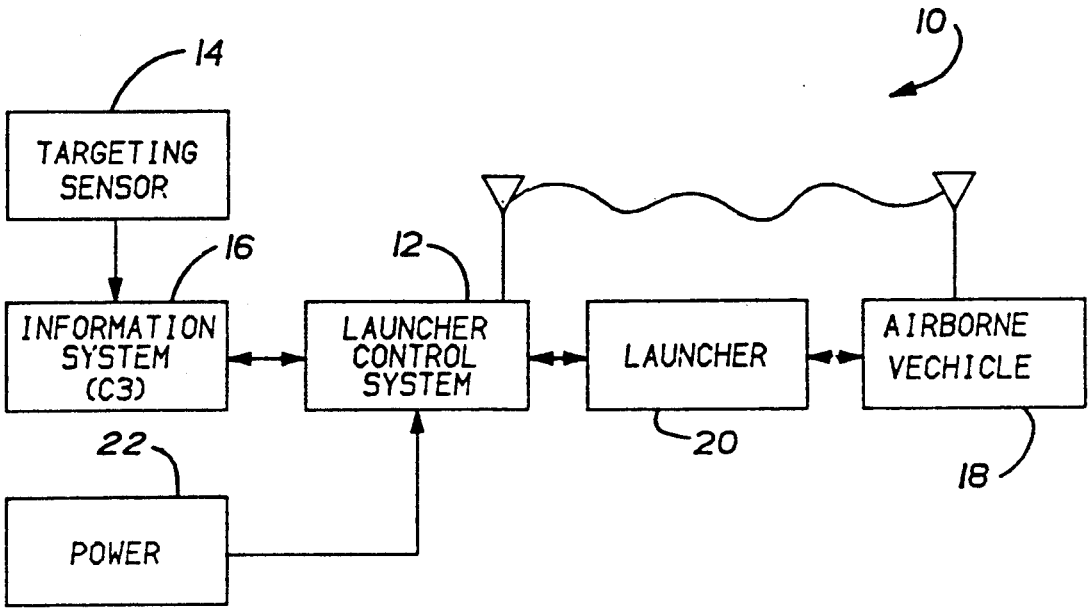
FIG. 1 is a schematic diagram of a weapon system incorporating the launcher control system.

Turning first to the weapon system 10 of FIG. 1, target position information is continuously obtained by a sensor 14, such as a radar system. This position information is processed by the information system 16, commonly referred to as the Communication, Command, and Control (C3) System, which generates position control signals for prelaunch testing and flight control of the airborne vehicle 18, such as a missile. Briefly, the C3 System is a combination of computer and communications technology and people. The communications technology collects and disseminates information, the computer technology processes the information, and people make decisions based on the information. The information system 16 is coupled to the launcher control system 12, which processes the position information and sends it to the airborne vehicle 18. Before launch, the airborne vehicle 18 receives position information and control signals through the launcher 20. In flight, the launcher control system transmits updated target position information to the airborne vehicle 18. The launcher control system 12 also monitors the prelaunch status of both the launcher 20 and the airborne vehicle 18 and relays the status information back to the information system 16. Power for operating the launcher control system 12 and for activating the airborne vehicle 18 during prelaunch checkout comes from power source 22.

Figure 2:
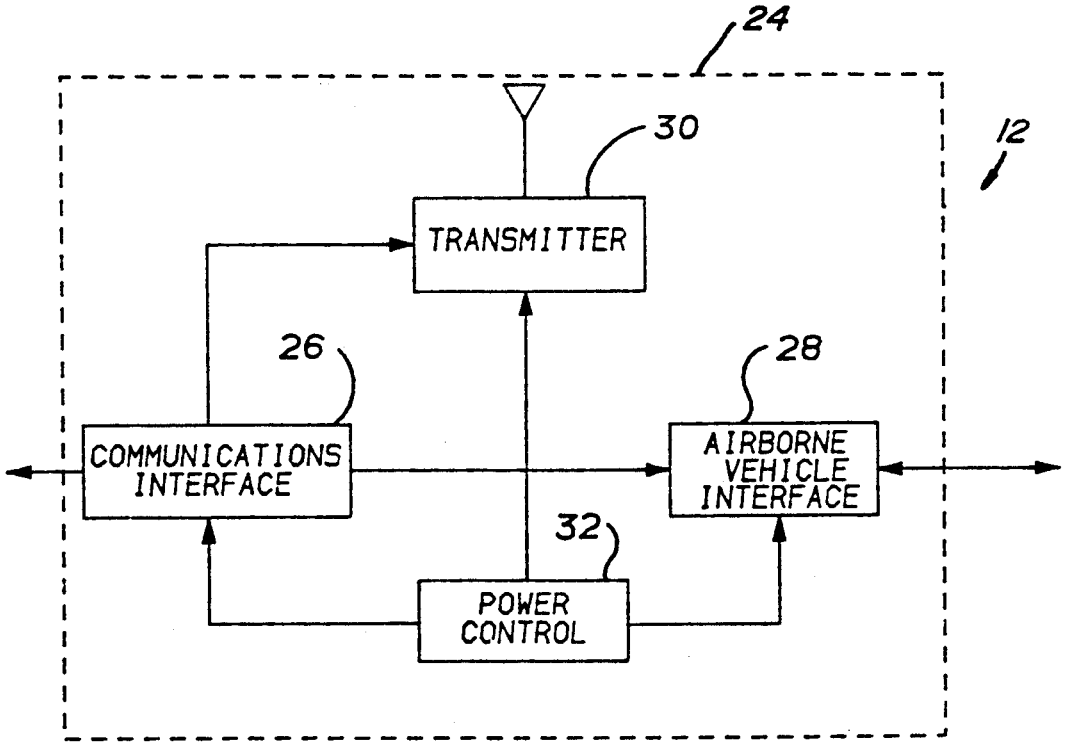
FIG. 2 is a schematic diagram of the launcher control system.

FIG. 2 illustrates the basic components of the launcher control system 12. The launcher control system 2 provides a standard communications interface 26 which allows for communication, launch and guidance of the missile from any information system 16 which has this standard interface. In the preferred embodiment, the commercially available standard RS422 serial interface is used. The communications interface 26 performs the interface function for target position information from the target sensor 14, and for launch and control orders from the information system 16. The communications interface 26 also provides launcher 20 and airborne vehicle 18 status back to the information system 16 prior to airborne vehicle launch.

The launcher control system 12 communicates with the airborne vehicle 18 in two ways. Prior to launch, the airborne vehicle interface 28 is used. In the preferred embodiment, in which the airborne vehicle is a missile, the commercially available MIL-STD 1760 interface advantageously allows the use of standard unmodified production missiles. The airborne vehicle interface 28 provides target position information and control signals for test and launch of the airborne vehicle 18 and provides power for airborne vehicle activation during the prelaunch checkout. It also determines the status of the airborne vehicle 18.

During flight, the launcher control system 12 communicates with the airborne vehicle 18 through a guidance means 30. In the preferred embodiment, a radio frequency (RF) data link transmitter is used. Target position information from the communications interface 26 is transmitted by a transmitter. In the preferred embodiment, the launcher control system 12 provides 360° of data link coverage so that multiple simultaneous missile engagements can be managed over this full range.

The power control 32 supplies power to the communications interface 26, the transmitter 30, the airborne vehicle interface 28, the launcher 20, and the airborne vehicle 18. It converts available system power from the power source 22 to power forms required by these launch control system components. In addition, the power control 32 regulates launcher control system power and provides overload protection for all launcher control system components.

Figure 3:
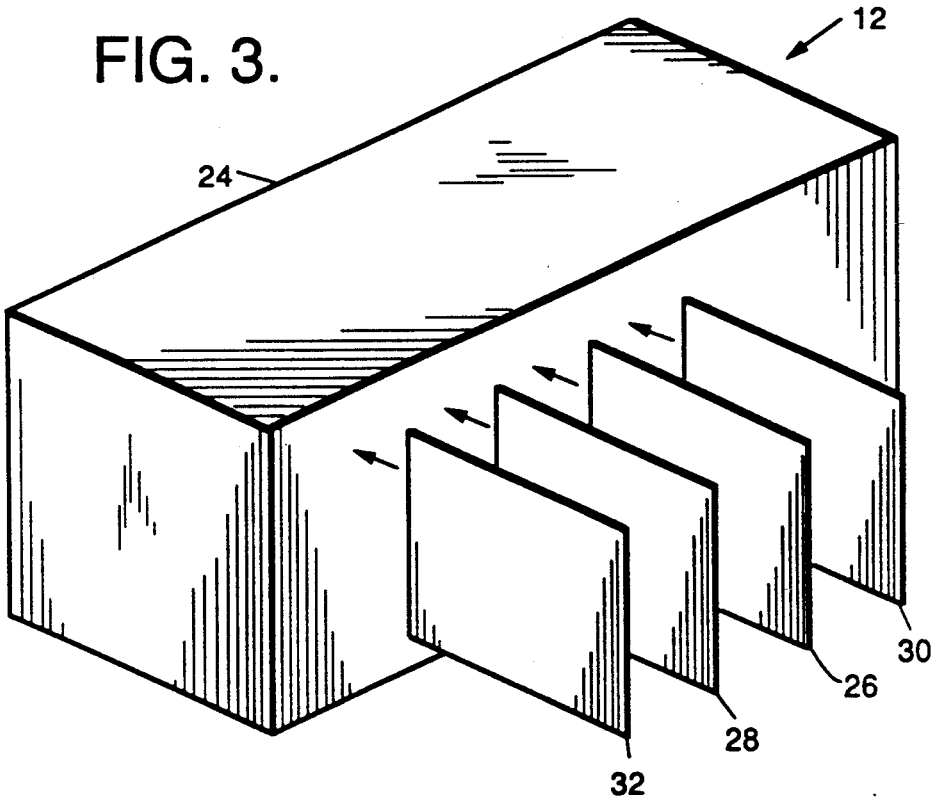
FIG. 3 is a simplified drawing of the launcher control system.

The launcher 20 with the launcher control system 12 is normally located apart from the information system 16 and target sensor 14, thereby making the launcher 20 and the airborne vehicle 18 less vulnerable to destruction by enemy forces. As shown in FIG. 3, the launcher control system 12 is housed in a box-like container such as housing 24 and is modular in design, thereby facilitating repair and replacement of components. Because it is a standard interface box, the launcher control system 12 is capable of being used to control an airborne vehicle 18, such as the AMRAAM, in many other environments besides air-to-air. Finally, many such launcher control systems are capable of being linked to a common information system 16 to allow the simultaneous launch of multiple airborne vehicles, such as active radar missiles of the AMRAAM type. These advantages over the prior art are readily apparent to one skilled in the art.

Although the invention has been described with particular reference to certain preferred embodiments thereof, variations and modifications can be effected within the spirit and scope of the following claims.

What is claimed is:

1. An apparatus for controlling an airborne vehicle, said apparatus being part of a system including a target position sensor, an information system coupled to the target position sensor, a power source, and a launcher, said apparatus comprising:

(a) communications interface means for coupling the information system to the launcher and airborne vehicle;

(b) airborne vehicle interface means for coupling said communications interface means and said power source to said launcher and said airborne vehicle;

(c) guidance means coupled to the communications interface means for communicating with the airborne vehicle after launch; said communications interface means, said airborne vehicle interface means, and said guidance means being separate from said target position sensor and said information systems;

(d) power control means for coupling said power supply to said communications interface means, said airborne vehicle interface means, sand said guidance means; and (e) housing means for enclosing said communications interface means, said airborne vehicle interface means, said guidance means, and said power control means;

said apparatus being modular in construction with said communications interface means, said guidance means, and said power control means being easily removable and replaceable.

2. The apparatus of claim 1 wherein said communications interface means received target position information from said target position sensor and launch and control orders from said information system and provides launcher and airborne vehicle status information to the information system.

3. The apparatus of claim 1 wherein said communications interface means comprises a standard RS422 serial interface.

4. The apparatus of claim 1 wherein said airborne vehicle interface means provides target position information and control signals for test and launch of said airborne vehicle, provides power from said power control means for activating said airborne vehicle, as well as determines the status of said airborne vehicle.

5. The apparatus of claim 1 wherein said airborne vehicle interface means comprises a MIL-STD 1760 interface.

6. The apparatus of claim 1 wherein said guidance means comprises a transmitter for transmitting target position information to said airborne vehicle.

7. The apparatus of claim 1 wherein said guidance means comprises a high frequency (RF) data link transmitter.

8. The apparatus of claim 1 wherein said power control means is capable of converting power from different power sources to power required by said communications interface means, said airborne vehicle interface means and said guidance means.

9. The apparatus of claim 1 wherein said housing means comprises a portable box-like container.

10. The apparatus of claim 1 wherein said airborne vehicle is a missile.

11. An apparatus for controlling an airborne vehicle, said apparatus being part of a system comprising a target position sensor, an information system coupled to the target position sensor, a power source, and a launcher, said apparatus comprising:

(a) communications interface means for coupling the information system to the launcher and airborne vehicle, said communications interface means receiving target position information from said target position sensor and launch and control orders from said information system, and providing launcher and airborne vehicle status information to the information system, said communications interface means including an RS422 serial interface;

(b) airborne vehicle means for coupling said communications interface means and said power source to said launcher and said airborne vehicle, said airborne vehicle interface means providing target position information and control signals for test and launch of said airborne vehicle and power from said power control means for activating said airborne vehicle, and determining the status of said airborne vehicle;

(c) guidance means coupled to the communications interface means for communicating with the airborne vehicle after launch, said guidance means comprising a transmitter for transmitting target position information to said missile;

(d) power control means for coupling said power supply to said communications interface means, said airborne vehicle interface means, and said guidance means, said power control means being capable of converting power from different power sources to power required by said communications interface means, said airborne vehicle interface means, and said guidance means; and (e) housing means for enclosing said communications interface means, said airborne vehicle interface means, said guidance means, and said power control means, said housing means comprising a box-like container being portable and separate from said target position sensor and said information system;

said apparatus being modular in construction with said communications interface means, said airborne vehicle interface means, said guidance means, and said power control means being easily removable and replaceable.

12. The apparatus of claim 11 wherein said airborne vehicle is a missile.

13. A method for controlling an airborne vehicle, said airborne vehicle being part of a system comprising a target position sensor, ann information system coupled to the target position sensor, a power source, a launcher, and a launcher control system including communications interface means for coupling the information system to the launcher and airborne vehicle, airborne vehicle interface means for coupling said communications interface means and si power source to said launcher and said airborne vehicle, and guidance means coupled to the communications interface means for communicating with the airborne vehicle after launch, said method comprising:

(a) positioning said launcher control system separately from said target position sensor and information system;

(b) applying power to said launcher control system;

(c) receiving target position information from said target position sensor and control orders from said information system;

(d) sending airborne vehicle status to said information system;

(e) sending target position information from said target position sensor and control orders obtained from said information system to said airborne vehicle through said airborne vehicle interface means;

(f) receiving airborne vehicle status from said airborne vehicle;

(g) sending target position information from said target position sensor to said airborne vehicle after launch through said guidance means;

(h) power control means for coupling said power source to said communications interface means, said airborne vehicle interface means, and said guidance means; and (i) housing means for enclosing said communications interface means, said airborne vehicle interface means, said guidance means, and said power control means;

said apparatus being modular in construction with said communications interface means, said guidance means, and said power control means being easily removable and replaceable.

* * * * *